United States Patent [19]

Brown et al.

[11] Patent Number: 5,045,043

[45] Date of Patent: Sep. 3, 1991

[54] FLAP OPENING MECHANISM AND METHOD

[76] Inventors: Michael A. Brown, 84 Field St., Norwalk, Conn. 06851; Carl A. Miller, 641 Jennings Rd., Fairfield, Conn. 06430; Morton Silverberg, 24 Edgewater Common, Westport, Conn. 06880; Steven A. Supron, 11 Comstock Hill Ave., Norwalk, Conn. 06850

[21] Appl. No.: 491,875

[22] Filed: Mar. 12, 1990

[51] Int. Cl.[5] ..... B31B 1/36

[52] U.S. Cl. ..... 493/245; 493/248; 493/409; 493/244; 53/381.1

[58] Field of Search ..... 493/244, 245, 309, 409, 493/410, 438, 439, 456, 248, 187, 188; 53/266 A, 381 R

[56] References Cited

U.S. PATENT DOCUMENTS

| | | | |
|---|---|---|---|
| 2,915,868 | 12/1959 | Copping | 53/381 |
| 2,982,076 | 5/1961 | Shelton | 53/381 R |
| 2,997,833 | 7/1961 | Nigrelli et al. | 53/382 |
| 3,068,622 | 12/1962 | Brownlee | 53/50 |
| 3,142,279 | 7/1964 | Arnett | 53/382 |
| 3,395,624 | 8/1968 | Seyl | 493/245 |
| 4,124,969 | 11/1978 | Peyton | 53/382 |
| 4,124,969 | 11/1978 | Peyton | 53/382 |
| 4,191,005 | 3/1980 | Vinoskey | 53/382 |
| 4,478,023 | 10/1984 | Becker | 53/382 |
| 4,843,801 | 7/1989 | Roncero | 53/492 |

FOREIGN PATENT DOCUMENTS

| | | | |
|---|---|---|---|
| 0473841 | 5/1951 | Canada | 493/309 |

*Primary Examiner*—Frederick R. Schmidt

*Assistant Examiner*—John A. Marlott

*Attorney, Agent, or Firm*—Robert H. Whisker; David E. Pitchenik; Melvin J. Scolnick

[57] ABSTRACT

An apparatus for producing items in selected configurations and a system and method for controlling the same. More particularly, an apparatus for producing mail pieces and a system and method for controlling it to produce mail pieces in a variety of configurations are disclosed. The apparatus includes a laser printer and folding sealing apparatus controlled by a data processor. The folder sealer apparatus combines sheets printed by the laser printer with pre-printed sheets and envelope forms, which also may be printed by the laser printer or may be windowed envelopes, folds the sheets as necessary and folds and seals the envelope form about the folded sheets to produce a mail piece. A user inputs a configuration for the mail piece which is translated by the data processor into a data structure and transmitted to the controller of the folder sealer apparatus. The controller controls devices comprised in the laser printer and the folder sealer by executing state routines in accordance with the data structure to produce the mail piece in the defined configuration. Concurrently the data processor transmits text from an output file to the laser printer for printing on printed sheets and envelope forms. The data processor also controls the laser printer to print an address for the mail piece either on an envelope form or on a printed sheet in a position where it will be visible through the envelope. Thus the apparatus is controlled to process an output file stored in the data processor into a mail run having a selected configuration. A mechanism and method for opening the side flaps of an envelope form is also disclosed.

11 Claims, 5 Drawing Sheets

FLAP OPENING MECHANISM AND METHOD

RELATED APPLICATIONS

The subject application is one of the following group of commonly assigned patent applications, all filed on even date herewith, all of which relate to a particular development effort conducted for the assignee of the subject application and which share common elements of disclosure.

| | | |
|---|---|---|
| Ser. No. 492,043 | Envelope Form For Preparing a Multi-Sheet Mail Piece | (C-624) |
| Ser. No. 491,871 | System and Method for Controlling an Apparatus to Produce Mail Pieces in Non-Standard Configurations | (C-625) |
| Ser. No. 492,039 | System and Method for Controlling an Apparatus to Produce Mail Pieces in Selected Configurations | (C-626) |
| Ser. No. 493,016 | System and Method for Producing Items in Selected Configurations | (C-631) |
| Ser. No. 491,881 | Mechanism and Method for Accumulating and Folding Sheets | (C-632) |
| Ser. No. 491,875 | Flap Opening Mechanism and Method | (C-633) |
| Ser. No. 491,886 | Mechanism and Method for Folding Folding and Sealing the Upper and Side Flaps of an Envelope Form | (C-634) |
| Ser. No. 491,887 | Mechanism and Method for Laterally Aligning an Accumulation of Sheets | (C-635) |
| Ser. No. 492,035 | Sheet Feeder | (C-636) |

BACKGROUND OF THE INVENTION

This invention relates to apparatus for producing mail pieces in a variety of configurations. More particularly, it relates to a mechanism and method used to open the side flaps of an envelope form so that the form may be accumulated with sheets comprising the contents of the mail piece.

Self-mailers are mail pieces which are produced from pre-cut forms which are folded and sealed to form a mail piece, and are well known, as is apparatus for printing and forming such self-mailers. Commonly assigned, co-pending U.S. application, Ser. No. 407,583, to: Samuel W. Martin, filed Sept. 14, 1989 (C-574) discloses one such self-mailer wherein a pre-cut form is printed on a laser printer, or similar computer output printer, and fed to a folding and sealing apparatus to produce a self-mailer. Similarly, U.S. Pat. No. 3,995,808 to: Kehoe, issued Sept. 7, 1976 discloses another self-mailer wherein a web of forms is printed, folded longitudinally and sealed, and separated to form individual self-mailers U.S. Pat. No. 4,063,398 to: Huffman, issued: Dec. 20, 1977 discloses another self-mailer wherein a web of forms is folded transversely to produce self-mailers. Huffman also provides for insertion of preprinted piece or "stuffers".

In general self-mailers as taught by the prior art are useful as a means of generating large numbers of mail pieces, but are limited in that they can be formed into only a small number of configurations. (By configurations, as applied to mail pieces herein, is meant variations such as use of a windowed or a printed envelope, variations in the number and type of printed pages, and variations in the number and type of pre-printed inserts). At most, like Huffman they may provide for an ability to insert "stuffers". Further, with the exception of the above mentioned U.S. application, Ser. No. 407,583 the equipment for producing such self-mailers has generally been physically large and suitable only for use in environments such as large computing centers.

Where it has been necessary to provide greater flexibility in the configuration of a mail piece which may be produced the solutions taught by the prior art have generally involved the use of inserters. An inserter is a transport system having a plurality of stations and along which a "control document" is transported from station to station. At selected stations pre-printed inserts maybe, accumulated with the control document and at the last station the entire accumulation is inserted in a pre-formed envelope. A typical use of such inserter systems would be by a bank mailing monthly statements to its customers, where the control document would be individual statements printed on the bank mainframe computer and the inserts would include each individual's cancelled checks. Such inserter systems are described, for example, in U.S. Pat. No. 3,935,429; to: Branecky et al,; For: Process and Apparatus for Controlling Document Feeding Machines From Indicia Contained on a Document Fed Therefor; issued: Jan. 27, 1973.

Inserters do provide a high degree of flexibility in producing mail pieces in a number of configurations, and have proven very satisfactory for users such as banks and credit card companies. However, they suffer also from major limitations. First, because inserter systems generally do not operate under the control of the computer which prints the control document, a very significant problem exists in assuring that the proper inserts are matched with the correct control document. Because of this difficulty it ha generally been necessary to use window envelopes with inserter systems rather than printed envelopes, so that an dress pre-printed on the control document could be used to deliver the mail piece. Finally, inserters, like equipment for producing self-mailers, are generally quite physically large and suitable for use only in a large computer operation or production mail room.

Another approach to the problem of producing mail pieces was developed by Pitney Bowes Inc., assignee of the subject invention, under contract with the U.S.P.S. This equipment, known as PPHE (for Printing and Paper Handling Equipment) printed a continuous web, collated and separated the web to form sheets, folded the collated sheets longitudinally, and wrapped an envelope form around the wrapped sheets. The PPHE had a capability to add "stuffers" to a mail piece and was intended for production applications only, as the equipment was tens of feet long. The PPHE lacked capability to print envelope forms or handle variable length sheets.

As is disclosed in commonly assigned, co-pending U.S. patent application for: System and Method for Producing Items in Selected Configurations; filed on even date herewith (C-631), it is highly desirable, to overcome the disadvantages described above, to provide an apparatus for producing mail pieces which are useful in an office environment and adapted to office equipment such as laser printers. As is also disclosed in the above mentioned patent application it is also desirable for such equipment to directly print envelope forms. A particular problem that arises in such equipment is that commercially available laser printers and the like have a paper feed path which is limited to standard paper sizes, typically 8 ½ inches. In order for an envelope form to pass through such a laser printer its side flaps must be folded inwards to a closed position, and than must be opened outwards so that the envelope form can be accumulated with the sheets comprising the contents of the mail piece.

Accordingly, it is an object of the subject invention to provide a mechanism for opening the side flaps of an envelope form.

It is another object of the subject invention to provide such a mechanism which will operate on the envelope as it is being transported.

DETAILED DESCRIPTION OF PREFERRED EMBODIMENTS OF THE SUBJECT INVENTION

Figure 1:
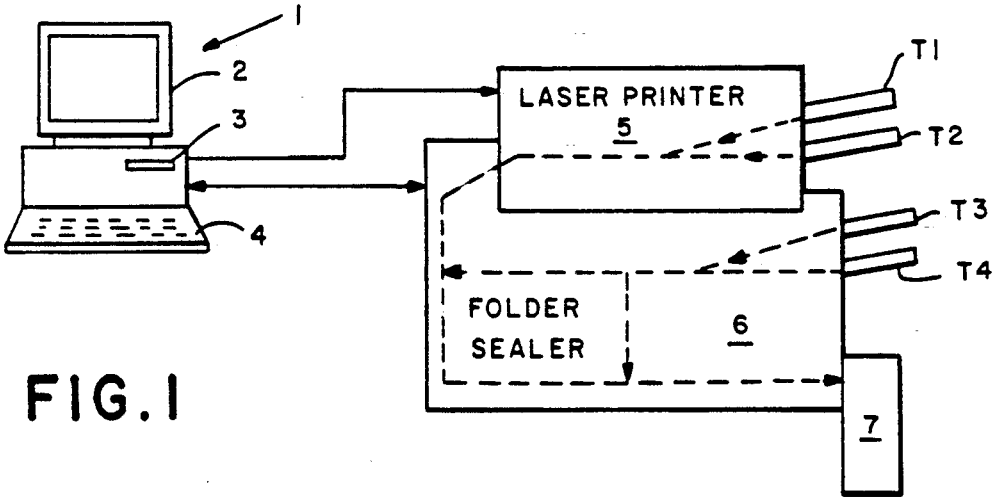
FIG. 1 shows a schematic block diagram of apparatus in which the subject invention may be used.

FIG. 1 shows a system for producing mail pieces and in which the mechanism and method of the subject invention may be used. The system includes a personal computer 1. including a monitor 2, a hard disk 3 with a minimum of one megabyte of available storage, and a keyboard 4. Computer 1 also requires a minimum of 640K of RAM memory in the subject invention. Optionally a computer "mouse" (not shown) may be provided for operator input. Computer 1 communicates with laser printer 5 through a conventional parallel interface which is preferably the well known Centronix interface. Preferably, Laser printer 5 is a commercially available Laser printer such as those marketed by the Hewlett Packard Corporation under the trademark "Laser Jet". Other printers, including ink jet and impact printers, may also may be used in the subject invention.

Laser printer 5 includes trays T1 and T2 from which sheets are fed to laser printer 5 for printing, as will be described further below. Tray T1 may be used for envelope forms, and tray T2 may be used for either three-thirds sheets or two-thirds sheets.

Laser printer 5 is mounted on, and physically connected to, folder sealer 6 so that, after printing, sheets are passed from laser printer 5 to folder sealer 6 where they are accumulated with an envelope form, folded and sealed, and output to stacker 7. Folder sealer 6 also includes trays T3 and T4 which may be used to add pre-printed sheets to the mail piece. Tray T3 and tray T4 may be used to supply either three-thirds, two-thirds, or one-thirds length pre-printed sheets or pre-printed business reply envelopes (BRE's) to be added to the mail pieces. Tray T3 may also be used to provide a window envelope form so that the address of the mail piece may be printed on a printed sheet rather than a separate (non-window) envelope form.

Figure 2:
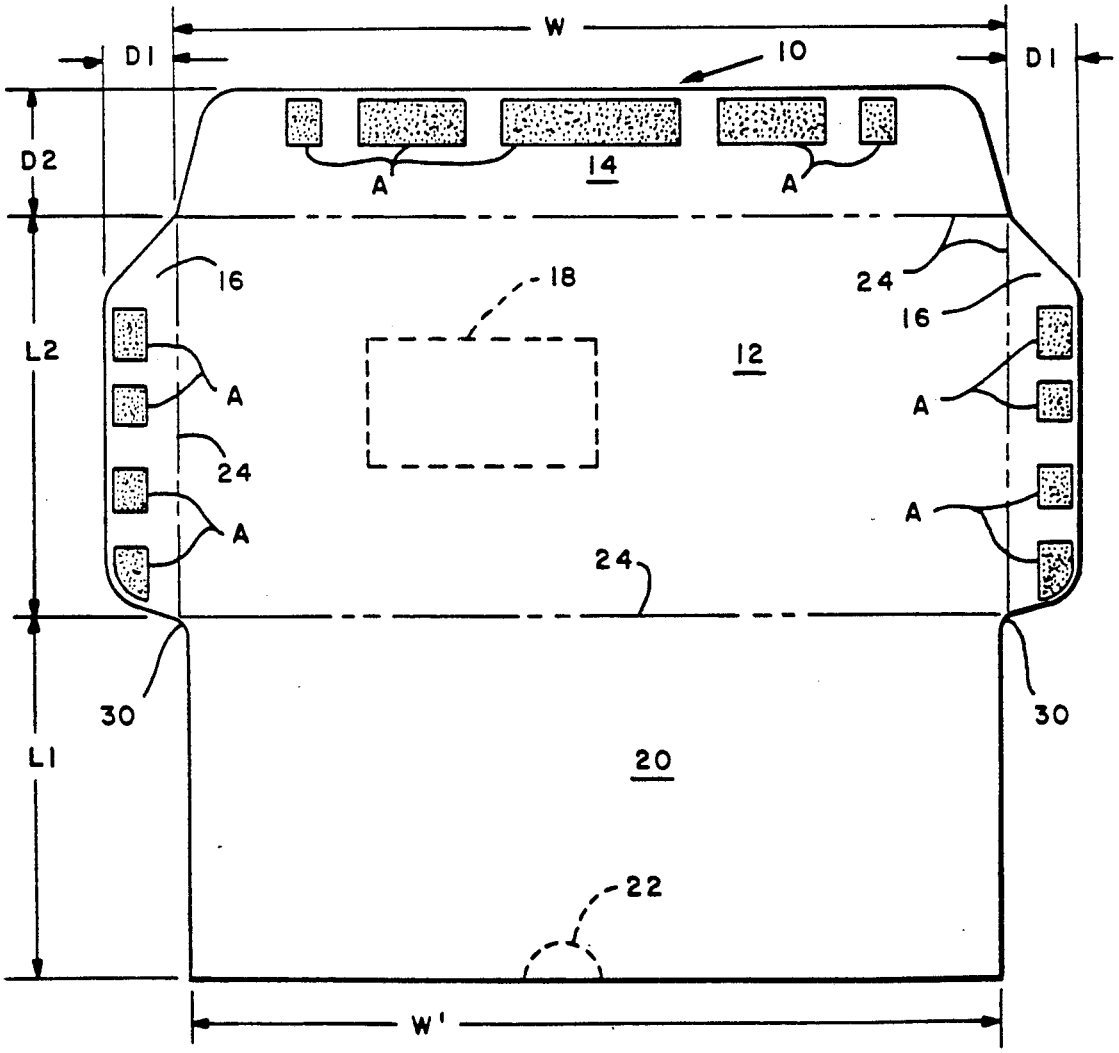
FIG. 2 shows a plan view of an envelope form suitable for use with the apparatus of FIG. 1.

FIG. 2 shows a unique envelope form, which is designed to function optimally with the apparatus of the FIG. 1. Form 10 includes upper panel 12 having an upper (or trailing) flap 14 and a pair of side flaps 16. Panel 12 may also be provided with a window 18 so that the mail piece formed when form 10 is folded and sealed may be delivered to an address printed on a sheet in the mail piece. An adhesive A is applied to flaps 14 and 16 to provide for sealing of form 10 to form an envelope. Preferably adhesive A is applied to flaps 14 and 16 as spaced stripes or spots so that form 10 may be driven through the apparatus of the subject invention by segmented rollers contacting form 10 in the spaces between the stripes or spots of adhesive A so that the rollers will not be contaminated by adhesive A when it is moistened prior to sealing, and, also, to reduce curling of the form. Adhesive A is preferably a remoistenable adhesive (such as 0.0006 to 0.001 inches of dextrin/resin adhesive) which is moistened for sealing as will be described further below, but the use of self-adhesive or other suitable methods of sealing is within the contemplation of the subject invention. Flaps 14 and 16 are attached to upper portion 12, as is a rectangular lower portion 20, along preformed fold lines 24, which are preferably pre-creased to facilitate uniform folding.

To form a mail piece, sheets, which may be three thirds, two-thirds, or one-thirds sheets or BRE's, are accumulated with form 10, and form 10, together with the accumulated sheets, is folded about a fold line 24 so that the accumulated sheets are enclosed between panels 12 and 20, Adhesive A is moistened, and after folding of panels 12 and 20 and the accumulated sheets, flaps 16 are folded inwards about fold lines 24 and flap 14 is than folded downwards about fold lines 24, and the resulting mail piece is sealed.

Note that three-thirds length sheets are prefolded to two-thirds length so that the resulting mail piece is approximately one-third the length of a three-thirds sheet.

Form 10 also may be provided with expansion fold lines parallel to and outwards of lines 24 to allow for mail pieces having a maximum thickness and lower panel 20 may be provided with a notch 22 to facilitate removal of the sheets when the mail piece is opened.

Form 10 is designed for optimal performance with the mechanism of the subject invention. The width W of upper panel 12 is chosen to be slightly greater than the width of the sheets to be used in the mail piece and the length L1 of lower panel 20 is chosen to be approximately equal to one-third the length of a full size sheet to be used with the mail piece. The length L2 of panel 12 is chosen to be substantially greater than length L1 to allow for increased tolerance in positioning these sheets on form 10 . The width W' of lower panel 20 is equal to the width of the sheets to be used in the mail piece. By providing width W' equal to the width of the sheets automatic centering guides may be used to center the sheets with respect to form 10 before it is folded as will be described further below. Further, a narrower lower panel 20 allows greater skew tolerance in folding the lower panel, and aids in enveloping the contents of thickener mail pieces by permitting side flaps 16 to wrap more gradually about the mail piece.

Because lower panel 20 is substantially shorter than upper panel 12 the width D of side flaps 16 and length D2 of upper flap 14 are chosen to be sufficient to assure that the sealed mail piece completely encloses these sheets. Upper flap 14 is also formed to be substantially rectangular to assure that the envelope is closed across its full width, and lower panel 20 is provided with bevels 30 so that it flares to the full width of upper panel 12 to assure that the lower corners of the completed mail piece are closed. It should also be noted that adhesive A on side flap 16 is applied so that it extends no further than lower panel 20 when the envelope is folded and does not come into contact with the sheets within the mail piece.

For a standard 8 ½×11 size three-thirds sheet the following approximate dimensions have been found to be satisfactory for form 10.

Figure 3:
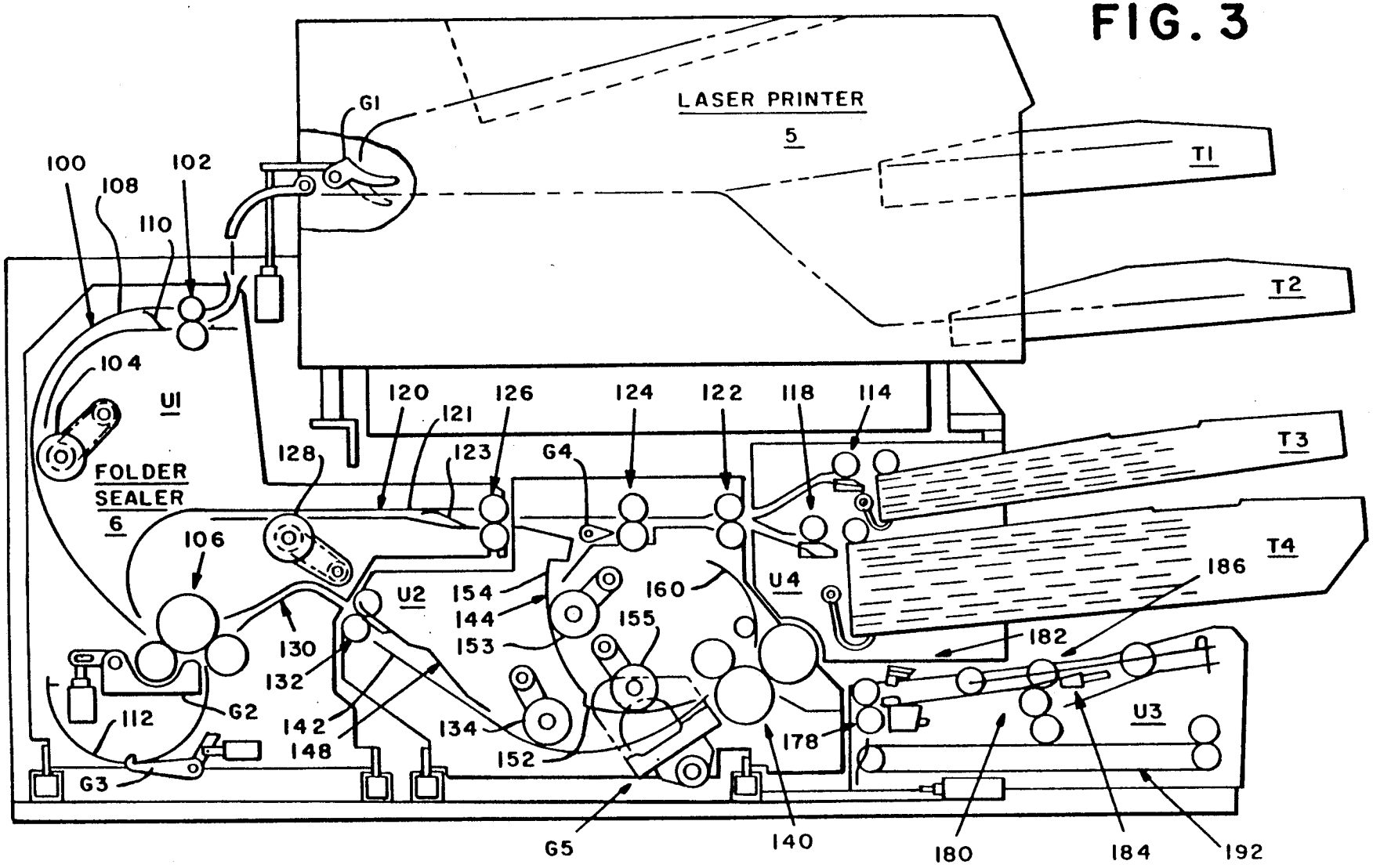
FIG. 3 shows a semi-schematic side view of a printer and a folder sealer apparatus used in the apparatus of FIG. 1.

D1=0.75 inches
D2=1.31 inches
L1=3.75 inches
L2=4.13 inches
W=8.70 inches
W'=8.50 inches Turning now to FIG. 3 a semi-schematic side view of folder sealer 6 is shown. As a printed envelope form 10 or a printed sheet exit laser printer 5 it is driven along guides 100 by roller pair 102 and then urged into the nip of accumulator folder assembly 106 by urge roller 104 until it reaches accumulator folder assembly 106. (As used herein a sheet is "urged" when it is moved by an "urge roller" constructed to slip on the sheet before the sheet will buckle under the load. This contrasts with sheets which are driven by a roller pair in a positive manner, substantially without slipping.) Normally the first item will be an envelope form 10 and gate G2 will be in the activated (closed) state diverting form 10 for further processing as will be described further below. Normally following items will be printed sheets and motor M1 (shown in FIG. 6), which drives folder accumulator assembly 106, will be stopped and the sheets will be urged into the nip of assembly 106 by urge roller 104, which will continue to rotate. Because guide 100 is curved to increase the stiffness of the sheets roller 104 will slip on the sheet as it is driven into the nip of assembly 106 before the sheets buckle. Relief 108 and spring 110 are provided in guide 100 so that the tail of any three-thirds sheet is held clear of roller pair 102 so that following printed sheets may be accumulated in the nip of assembly 106.

If the sheets accumulated in the nip of assembly 106 include a three-thirds sheet gate G2 is deactivated (open) and motor 1 is started and the accumulated sheets are driven into curved, open, one sided buckle chute 112. The assembled sheets are folded by assembly 106 to a two thirds length and exit assembly 106 for further accumulation with the previously passed form 10. Gate G3 may be activated for a "Z" fold (normally used with a window envelope); as will be described further below.

Alternatively a windowed envelope or pre-printed sheets, of three-thirds length, may be fed from trays T3 or T4 by feeder assemblies 114 or 118 and, with gate G4 deactivated, driven along curve guides 120 by roller pairs 122, 124, and 126 and urged by urge roller 128 for processing by accumulator folder assembly 106 in the same matter as described above for printed envelope forms 10 and printed sheets. Relief 121 and spring 123 are provided to assure that following sheets pass over previous sheets for accumulation.

If the sheets accumulated in the nip of assembly 106 are all two-thirds length the assembled sheets exit assembly 106 along guide 130 without folding.

The previously processed form 10, followed by the assembled sheets, is moved along guides 130 by roller pair 132 and urge roller 134 until it is driven into the nip of accumulator folder assembly 140. Motor M2 (shown in FIG. 6), which drives assembly 140 is off and the leading edge of the accumulated sheets is aligned with the edge of lower panel 20 of form 10 in the nip of assembly 140. In the same manner as previously described guides 130 are curved to increase the stiffness of form 10 and the accumulated sheets. Relief 142 operates as described above so that the accumulated sheets will clear form 10 and progress to the nip of assembly 140.

Since laser printer 5 will normally have a feed path designed for a conventional paper size (e.g. approximately 8 ½") envelope form 10, when fed through printer 5 is fed with flaps 16 folded into the closed position. Accordingly, an opening mechanism 148 is provided along path 130 to open flaps 16 before form 10 is accumulated with the following sheets.

Lateral guides G5 are provided to assure that the sheets are centered with panel 20 of form 10.

If two-thirds sheets, one-third sheets, or BRE's are fed from trays T3 or T4 along guides 120 gate G4 is activated and these sheets are diverted to guides 144. The diverted sheets are urged by urge rollers 153 and 155 into the nip of assembly 140 and are accumulated in the manner described above in the nip of assembly 140 with the previously processed envelope form 10, and any pre-folded printed or pre-printed three-thirds sheets. Guides 144 include relief 152 for one-thirds pre-printed sheets and BRE's and relief 154 for two-thirds pre-printed sheets.

After all sheets are accumulated with form 10, motor M2, which drives accumulator folder assembly 140, is started and drives the completed accumulation into buckle chute 160 so that the completed accumulation is folded about crease 24 between upper panel 12 and lower panel 20 of form 10. As the folded accumulation exits from assembly 140 it is captured by roller pair 178 and carried into flap folder sealer assembly 180. There adhesive A is moistened by moistener 182, side flaps 16 are closed by closing mechanism 184 and tailing flap 14 is closed, and all flaps are sealed by roller assembly 186. At this point form 10 and the accumulated sheets have been formed into a sealed mail piece. The sealed mail piece than is transported by transport 192 and exits folder sealer 6.

As sheets are driven into the nips of assemblies 106 and 140 with motors M1 and M2 not operating, any slight skew of the sheets with respect to the path of travel will be corrected as the leading edge of the sheets (or envelope form) are driven into the stationary nip. However, if the skew of the sheets is too great the leading corner may bind in the nip preventing correction of the skew. To avoid this it may prove desirable to briefly operate motors M1 and M2 in a reverse direction to allow the leading edges of the sheets to align themselves parallel to the nips as they are driven against them.

As will be described below appropriate velocity profiles for motors M1 and M2 are readily achieved since motors M1 and M2 are stepper motors having readily controllable velocity profiles. (While stepper motors have proven adequate, other forms of motor, such as conventional brushless d.c. gear motors, which have better torque characteristics, are within the contemplation of the subject invention, and may prove preferable.)

Figure 4:
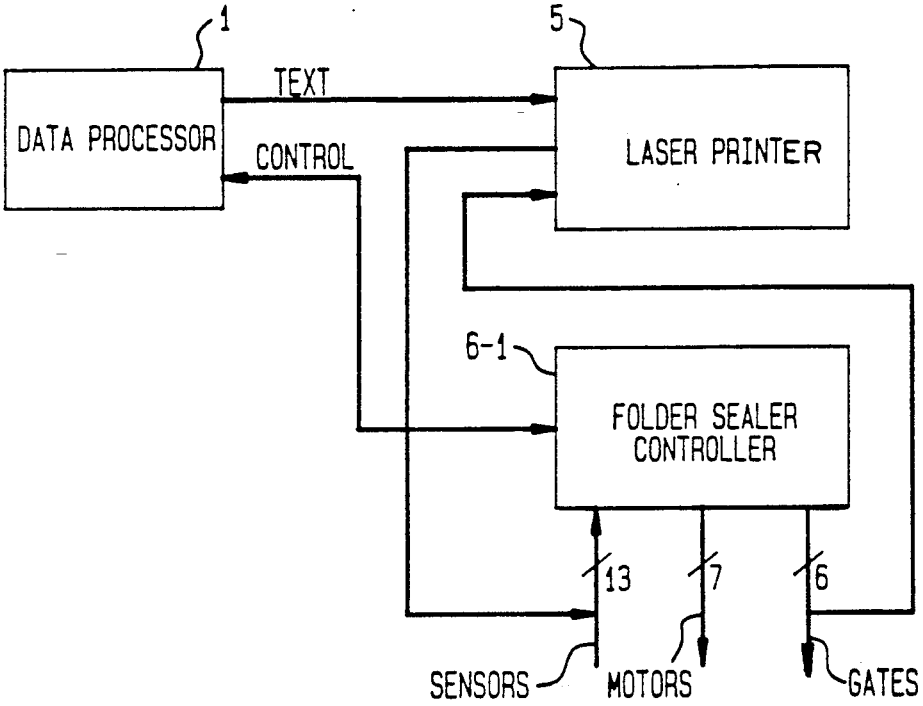
FIG. 4 shows a schematic block diagram of the flow of control and text information signals in the apparatus of FIG. 1.

Turning to FIG. 4 the control architecture for the system for the subject invention is shown. As described above data processor 1 controls laser printer 5 through a parallel interface in a conventional manner to print text. Folder sealer 6 is controlled through a conventional serial communications port, such as an RS232 port. Folder sealer 6 is controlled by controller 6-1 which includes an integrated circuit microncontroller which is preferably a model 80C196KB manufactured by the Intel Corporation of California. As will be described below controller 6-1 receives data structures defining the configuration for mail pieces in a given mail run, from data processor 1, as well as specific information for each mail piece, such as ID numbers and variable numbers of printed sheets to be included in the mail piece. Controller 6-1 than controls devices (i.e. sensors, motors, and gates) in folder sealer 6 to produce mail pieces in accordance with the data structures and specific mail piece information. As can be seen in FIG. 4, minor modifications, easily within the skill in the art, have been made to laser printer 5 to allow controller 6-1 to read sensors S1, S2 and S3 provided in laser printer 5 and control gate G1 which is also part of laser printer 5.

Figure 5:
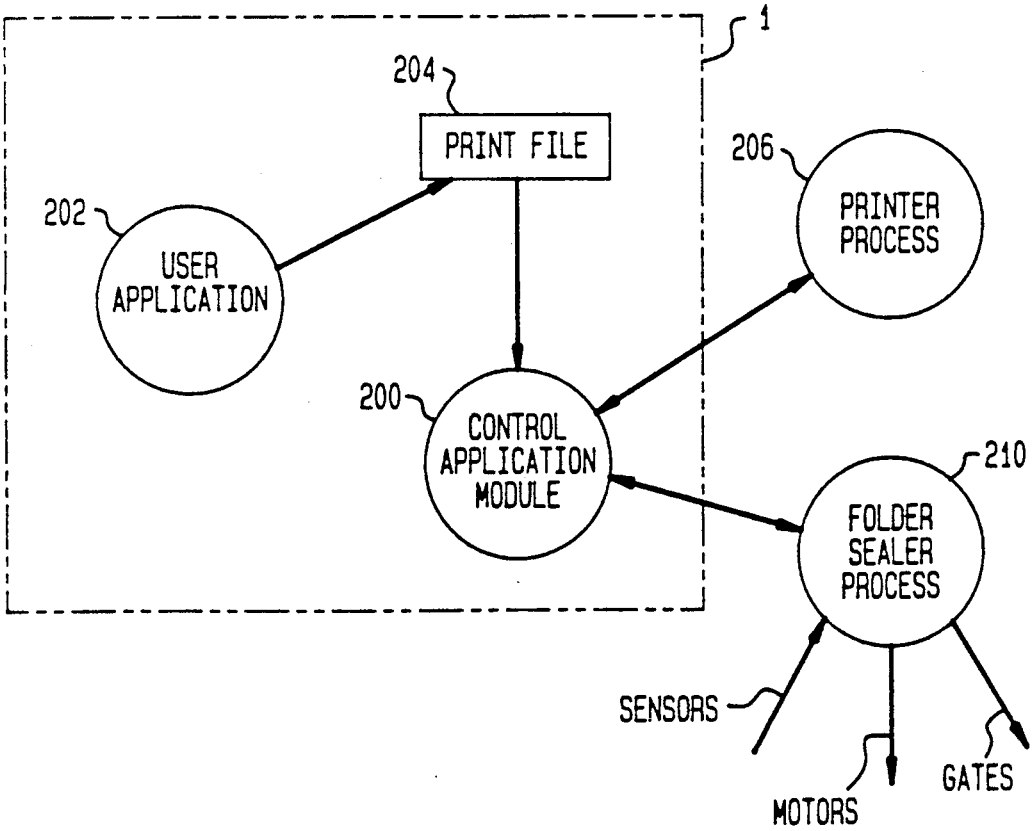
FIG. 5 shows a data flow diagram for the apparatus of FIG. 1.

FIG. 5 shows the software architecture for the subject invention. In accordance with the subject invention data processor 1 runs a Control Application Module 200 to process documents produced by a conventional user application program 202 and output to a conventional print file 204. Control Application Module 200 includes a conventional printer driver to communicate with Printer Process 206 to print text from the documents in file 204 in a known, conventional; manner and a conventional, serial communications driver to communicate with folder sealer process 210 which runs in folder sealer controller 6-1. Module 200 also includes a Control Application Program which enables a user to define the mail piece configuration for a particular mail run. Data structures defining this configuration, as well as specific mail piece information are communicated to process 210 by the Communication Driver, and process 210 controls motors and gates in response to sensors to produce mail pieces comprising documents produced by the user application 202 and having a configuration in accordance with the data structures and specific mail piece information; as will be described further below.

Figure 6:
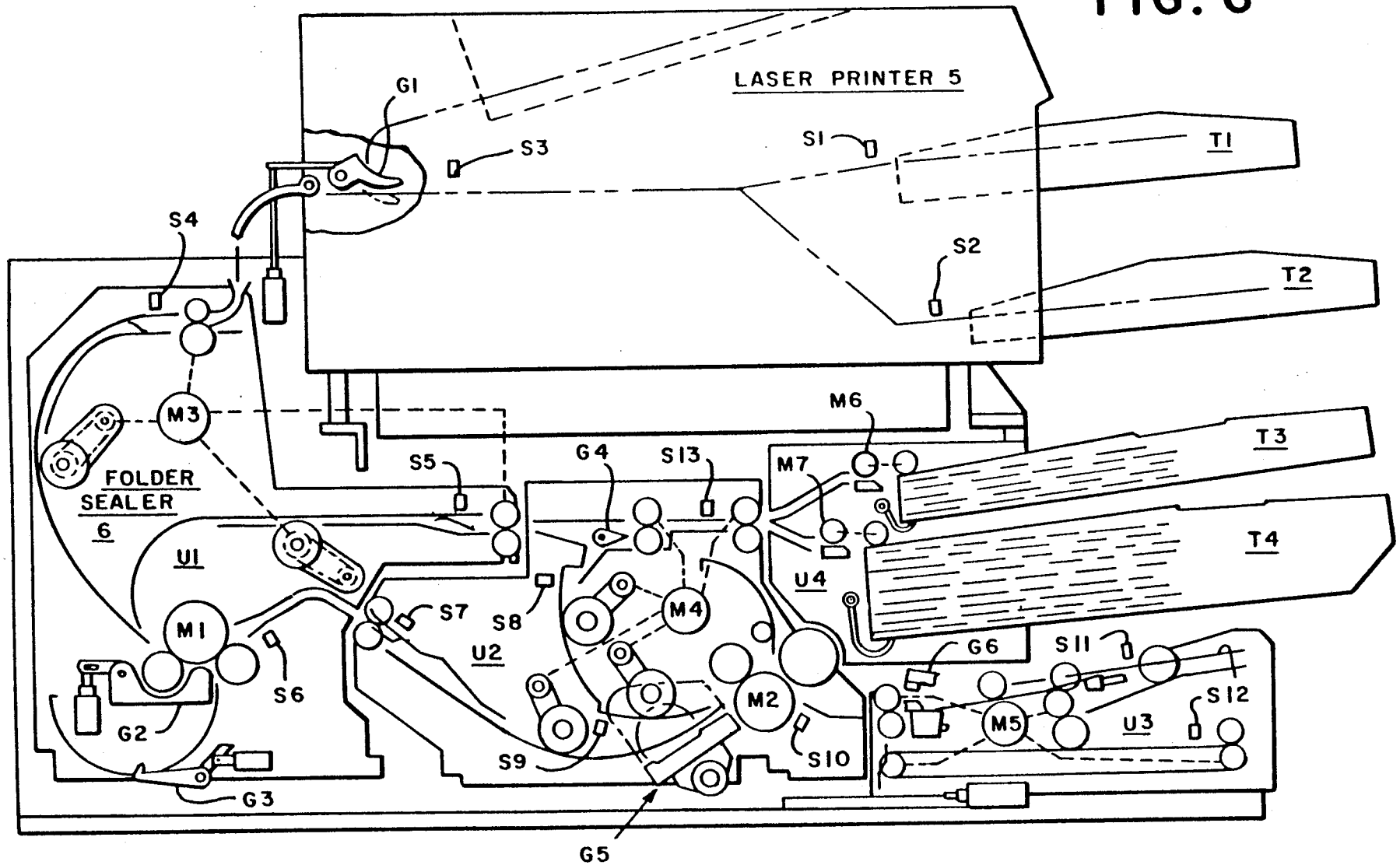
FIG. 6 shows the view of FIG. 3 showing the relationships of sensors, gates, and motors.

FIG. 6 is a schematic diagram of the sensors, motors and gates used in the prefer embodiment of the subject invention shown in FIG. 3. Sensors S1, S2 and S3 are part of commercially available laser printer 5. In the embodiment shown sensors S1 and S2 are provided by monitoring the feed signals to trays T1 and T2, though optical sensors to positively detect passage of sheets are, of course, within the contemplation of the subject invention. Sensor S3 is an optical sensor also provided in laser printer 5 which monitors output of sheet after printing. Gate G1 is a mechanical gate also part of laser printer 5, which diverts sheets for output on top of laser printer 5, and as noted, has been modified so that it operates under control of controller 6-1. Sensor S4 is an optical sensor provided in folder sealer 6 to detect passage of a printed sheet from laser printer 5 to folder sealer 6 along guide 100. Sensor S5 is an optical sensor which detects the presents of pre-printed sheets on guide 120 downstream of gate G4. Sensor S6 detects the presence of sheets output from accumulator folder assembly 106 on guide 130, and sensor S7 detects the presence of sheets accumulated in the nip of folder accumulator assembly 140. Sensors S8 and S9 detect the presence of two-thirds and one-third sheets, respectively, which have been diverted from guide 120 by gate G4 to accumulated apparatus 140. Sensor S10 is an optical Sensor which detects the presence of a folded envelope form 10 and accumulated sheets output from assembly 140 and sensor S11 is optical sensor which detects the presence of form 10 and the accumulated sheets in flap folder sealer 180. Sensor S12 is an optical sensor which detects the output of a folded and sealed mail piece. Sensor S13 is an optical sensor which detects the presence of pre-printed sheet on guide 120 upstream from gate G4.

Gate G1 diverts sheets after printing for output at the top of laser printer 5 so that laser printer 5 may be used as a conventional computer output line printer without printed sheets passing through folder sealer 6, and also to facilitate recovery from jam conditions. When activated gate G2 diverts envelope form 10 and two-thirds length printed sheets through assembly 106 without folding. When activated gate G3 effectively shortens the length of buckle cute 112 so that sheets accumulated for folding by assembly 106 are ultimately folded in a "Z" fold, and when deactivated allows the full length of the accumulated sheets into buckle chute 112 so that these sheets are ultimately folded in a "C" fold. Gate G4 when activated diverts pre-printed two-thirds and one-thirds length sheets and BRE's from guide 120 to guide 144 for accumulation at accumulator folder assembly 140.

As will be described further below gates G5 and G6 are different from the other gates in that they do not change the path followed by sheets as they move through folder sealer 6. However, for control purposes they are handled as gates. Gate G5 is actually a pair of symmetrically movable lateral guides which are operated to assure that sheets accumulated with form 10 and apparatus 140 are laterally aligned with form 10. Gate G6 is a moistening apparatus which moistens adhesive A on form 10 as it enters trailing flap folder sealer 180. Gates G1-G6 are each operated individually under direct control of controller G-1.

Motors M1 and M2 operate accumulator folder assemblies 106 and 140 respectively. Motor M3 operates urge rollers 104 and 128, and roller pairs 102 and 126, and motor M4 operates urge rollers 146 and 148 and roller pairs 122, 124, and 132 (all shown in FIG. 3).

Motor M5 operates flap folder sealer 180 and motors M6 and M7 feed pre-printed sheets trays T3 and T4, respectively. Motors M1 through M7 are each operated individually under the direct control of controller 6-1.

Figure 7:
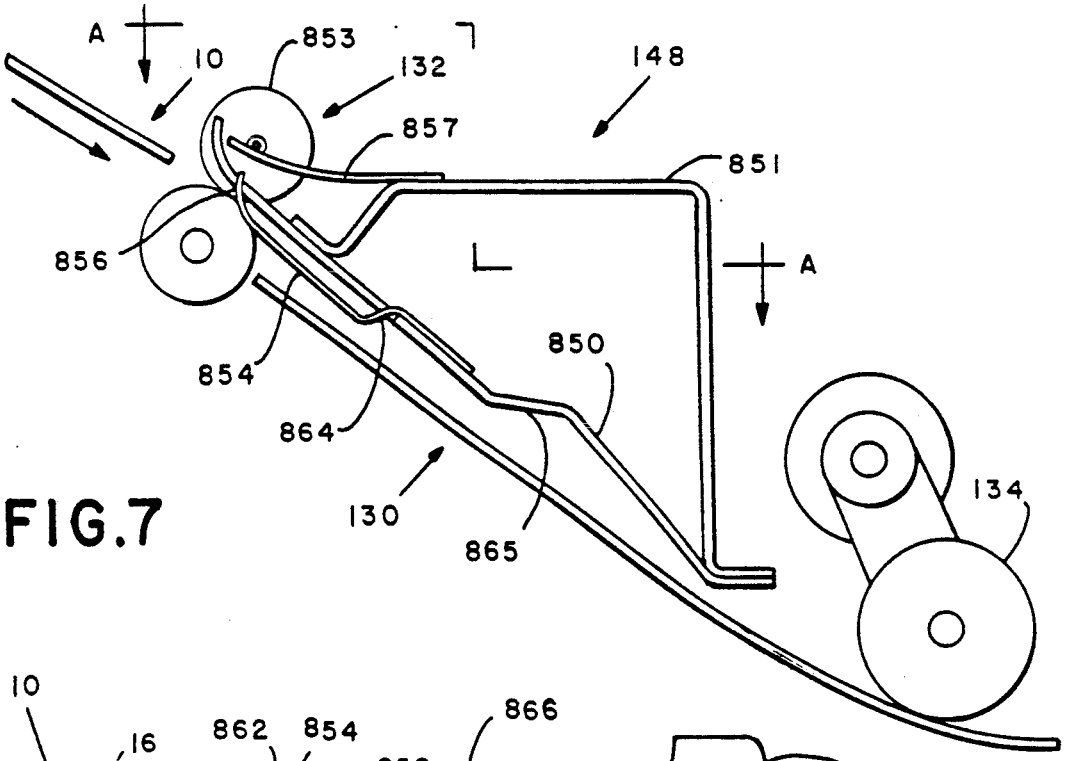
FIG. 7 shows a side view of a mechanism for opening the side flaps of the form of FIG. 2 in accordance with the subject invention.
Figure 8:
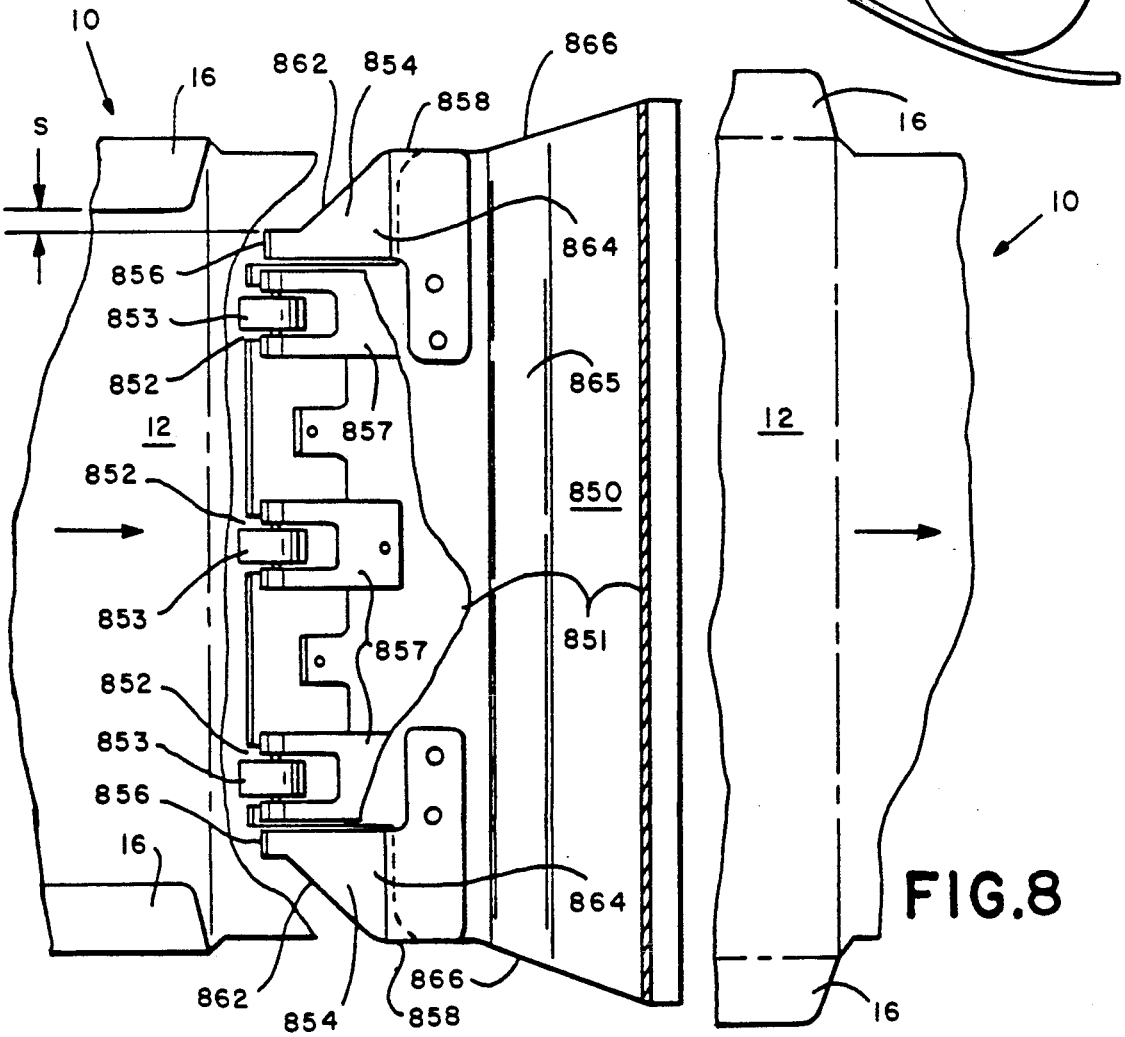
FIG. 8 shows a top view along lines A—A of FIG. 7.

Because printer 5 will normally be a commercially available laser printing engine the paper path through printer 5 is normally designed for standard paper widths, typically 8½". Thus where envelope form 10 is to be printed form 10 must pass through printer 5 with side flap 16 folded inwards, so that the width of form 10 does not exceed the capacity of laser printer 5. Accordingly, a flap opening mechanism 148 is provided, positioned between roller pair 132 and urge roller 134 to open side flaps 16 before envelope form 10 is accumulated with the printed or pre-printed sheets or BRE. Opening mechanism 148 is shown in FIGS. 7 and 8 and includes plate 850 fixed through bracket 851 to the frame of folder sealer 6 above guides 130 and provided with slots 852 through which segments 853 of the segmented upper roller of roller pair 132 bear against the lower roller. A pair of thin, flexible separator elements 854 are fixed to plate 850 so that elements 854 extend outwards from plate 850 symmetrically and forward so that tips 856 are proximate to and slightly above the nip of roller pair 132. Separator elements 854 are mounted essentially parallel to and co-planar with envelope form 10 as it passes through roller pair 132. Segments 853 are mounted on spring elements 857 to bear downwards against panel 12 to assist in separating flaps 16 from panel 12. Preferably tips 856 are curved upward so that they do not dig into sheets as they pass through roller pair 132. Elements 854 include outer edges 858 which are positioned parallel to and slightly inboard of fold lines 24 of form 10 as it is urged along guide 130. Knife edges 862 angle inwards to connect edges 858 and tips 856. Separator elements 854 are mounted so that tips 856 lie inboard of side flaps 16 by a small spacing S, whose actual dimension is not critical to the subject invention.

As envelope form 10 is urged along guide 130 panel 20 is engaged by roller pair 132 and passes below separators 854 without binding since, as noted, tips 856 are curved upwards. As form 10 progresses flaps 16 are separated from panel 12 by knife edges 862, and as form 10 progresses further flaps 16 are fully engaged by separators 854 with fold lines 24 adjacent and outwards of edges 858, which are preferably rounded to avoid the possibility of cutting form 10. As form 10 progresses further flaps 16 are first lifted by steps 864, and again lifted by downstream step 865; which is provided to assure that flaps 16 open smoothly and without tearing by assuring that leverage is applied well above fold lines 24, and which lifts side flap 16 away from panel 12 so that outwards angled edges 866 of plate 850 bear against the inner surfaces of flaps 16 above fold lines 24. As form 10 progresses further edges 866 apply outward leverage against flaps 16 forcing flaps 16 out and down into parallel alignment with panel 12 before form 10 is engaged by urge roller 134.

Guides 130 are shaped so that panel 12 and flaps 16 lie flat as flaps 16 are opened; to avoid crimping or buckling of flaps 16 as they are opened.

In one embodiment plate 850 angles downwards towards guides 130 to a minimum clearance of approximately 0.25 inches and edge 866 angles outwards so that at its widest plate 850 extends outwards of fold lines 24 to rotate flaps 16 into their unfolded position. This, together with the curvature of guides 130 as form 10 emerges from beneath plate 850, which further rotates flaps 16, assures that flaps 16 are fully open and parallel to form 10.

In another embodiment (not shown) edges 866 angle outwards so that at its widest plate 850 extends slightly outwards of flaps 16 in their unfolded position. This is believed to provide increased assurance that flaps 16 will be opened fully.

EXAMPLE

A prototype system, substantially as shown in FIG. 3 has been developed and tested and is believed to have satisfactorily achieved the objects of the subject invention. The following parameters have been found acceptable in the prototype system.

A sheet and form are input from laser printers at a velocity of approximately 2 inches per second along guide 100.

The final accumulation of form 10 with printed and pre-printed sheets is transported through flap folder sealer 180 at a velocity of approximately 3 inches per second.

Accumulator folder assemblies 106 and 140 and all other urge rollers and roller pairs transport sheets and/or form 10 at approximately 8 inches per second.

An input velocity of two inches per second matches the output laser printer 5, while the increase in velocity to eights inches per second allows time to accumulate sheets with form 10, to laterally align the final accumulation, and to fold it to one-third size (i.e. letter size). It is believed that the system speed can be increased to match higher speed printers with little effort.

Steps 864 and 865 in side flap opener mechanism 140 have a height of approximately 0.25 inches.

Form 10 and mechanism 148 are designed to provide a minimum nominal spacing s (shown in FIG. 8) between side flaps 16 and the beginning of knife edges 862 (i.e. the outboard edges of tips 856) of 0.25 inches.

The urge rollers apply a normal force in the range of two to five ounces. Lower levels of force are chosen where the sheet is urged over a longer distance, as the columnar stiffness of the sheet decreases with the length over which the load is applied.

The bearing surfaces of the urge rollers are micro-cellular urenthane and have a coefficient of friction of from 1.0 to 1.4.

Buckle chutes, and the portions of guides supporting sheets in the nips of assemblies 106 and 140, have radii of curvature (not necessarily constant) of from 2 to 5 inches.

Those skilled in the art will readily appreciate that the system shown in FIG. 1 provides an almost limitless ability to produce mail pieces having a selected configuration. In the prototype system the allowable combinations are limited by the following rules:

1. Each feeder tray: T1, T2, T3, T4 will have homogenous stock.
2. Each mail piece will include exactly one envelope.
3. Each mail piece will include at least one non-envelope.
4. Each mail piece having a window envelope, will include at least one printed sheet.
5. For each mail piece a feeder will supply no more than two one-thirds sized sheets.
6. Each mail piece will include no more than one BRE.
7. Because of the practical limitations on folding ability each mail piece will include no more than a total of three two-thirds size or three three-thirds size sheets.
8. Because of the practical limitations on envelope thickness each mail piece will be no more than twelve sheets thick, where BRE's are considered to be two sheets thick.

The above descriptions and examples have been provided by way of illustration only, and those skilled in the art will recognize numerous embodiments of the subject invention from the Detailed Description and attached drawings. Accordingly, limitations on the scope of these subject invention are to be found only in the claims set forth below.

What is claimed is:

1. A mechanism for opening side flaps of an envelope form, said side flaps being jointed to said form along fold lines and having a width perpendicular to said fold lines, said form lying substantially in a plane and said side flaps being rotated inwards to a closed position to lie substantially co-planar with said form said mechanism comprising:

a) means for transporting said form substantially in said plane in a direction parallel to said fold lines;

b) a plate, said plate including a forward portion lying inboard of said closed position of said flaps, a rear portion extending outboard of said fold lines in an open position of said flaps, and angled edges extending from said forward position to said rear portion, at least said forward portion being substantially parallel to said plane and spaced from said plane by a distance less than said width of said flaps c) separator elements positioned substantially co-planar with said form, said separator elements having tips positioned inboard of said closed position of said flaps, outer edges substantially parallel to and inboard of said fold lines and outboard of and behind said tips, said knife edges angled outwards from said tips to said outer edges; and d) steps connecting said separator elements to said plate; whereby e) as said form is transported said flaps are separated from said form by said knife edges, and as said form is transported further said side flaps are fully engaged by said separator elements until said side flaps reach said steps which displace said flaps to contact said angled edges of said plate, where upon, as said form is transported further said angled edges bear upon said side flaps away from said fold lines causing said side flaps to rotate outwards to said open position.

2. A mechanism as described in claim 1 wherein at least said rear portion of said plate is angled towards said plane to a final spacing of approximately 0.25 inches, whereby said flaps are substantially co-planar with said form in said opened position.

3. A mechanism as described in claim 1 further comprising spring mounted means for applying a force against said form between said flaps to hold said form against said transport means as said side flaps engage said knife edges, said force assisting in separating said flaps from said form.

4. A mechanism as described in claim 3 wherein said transporting means comprises a pair of rollers and said force applying means comprises one of said rollers.

5. A mechanism as described in claim 4 wherein said separator elements comprise thin, flexible members.

6. A mechanism as described in claim 1 wherein said separator elements are fixed to said plate and said connecting steps comprise bent portions of said flexible members.

7. A mechanism as described in claim 1 further comprising second steps formed in said plate downstream from said connecting steps for further displacing said flaps, whereby the possibility of tearing along said fold lines is reduced.

8. A mechanism as described in claim 1 wherein as said form exits said mechanism it is transported along a curved path to assist in opening said flaps.

9. A method for opening side flaps of an envelope form, said side flaps being joined to said form along fold lines, said form lying substantially in a plane and said side flaps being rotated inwards to a closed position to lie substantially co-planar with said form, said method comprising the steps of:

a) transporting said form in said plane in a direction parallel to said fold lines;

b) positioning separator elements to engage said side flaps and separate said side flaps from said form as said form is transported;

c) applying a force to said form between said flaps to hold said form down as said separator elements engage said side flaps, whereby said force assists separating said flaps from said form;

d) as said form is transported further, introducing a step in the path of said flaps to displace said side flaps upwards to engage outward angled edges, spaced above said plane, said edges thereby bearing against said flaps away from said fold lines and thereby rotating said side flaps to an open position.

10. A method as described in claim 9 comprising the further step of displacing said flaps a second time to assure that said outward angled edges bear against said flaps sufficiently far away from said fold lines that the possibility of tearing said flaps is substantially reduced.

11. A method as described in claim 9 comprising the further step of then transporting said form along a curved path to further assist in rotating said flaps to an open positions.

* * * * *